US007086442B1

(12) United States Patent
Esparza

(10) Patent No.: US 7,086,442 B1
(45) Date of Patent: Aug. 8, 2006

(54) GARAGE SCREEN DOOR SYSTEM

(75) Inventor: Michael E. Esparza, Sacramento, CA (US)

(73) Assignee: Michael Esparza, Sac, CA (US)

( * ) Notice: Subject to any disclaimer, the term of this patent is extended or adjusted under 35 U.S.C. 154(b) by 0 days.

(21) Appl. No.: 10/609,465

(22) Filed: Jun. 26, 2003

(51) Int. Cl.
*E05D 15/08* (2006.01)

(52) U.S. Cl. ..... 160/113

(58) Field of Classification Search ..... 160/201, 160/96, 113; 292/120, 213, 218
See application file for complete search history.

(56) References Cited

U.S. PATENT DOCUMENTS 1,799,719 A * 4/1931 Zimmer ..... 160/95
1,832,246 A * 11/1931 Sampson ..... 160/19
2,440,541 A * 4/1948 Gash ..... 312/217
4,231,412 A 11/1980 Nowak
4,356,856 A * 11/1982 Bengtsson ..... 160/209
4,643,239 A * 2/1987 Wentzel ..... 160/201
4,712,598 A 12/1987 Bonacci et al.
5,014,466 A * 5/1991 Winner ..... 49/504
5,611,382 A 3/1997 Sferra
5,848,630 A * 12/1998 Manzo ..... 160/113
6,053,235 A 4/2000 Ruffner
D426,315 S 6/2000 Dillard
6,098,698 A 8/2000 King-Darr

* cited by examiner

*Primary Examiner*—Blair M. Johnson

(57) ABSTRACT

A garage screen door system for allowing air to flow into a garage. The garage screen door system includes a screen door member comprising a plurality of panels. Each of the panels is hingably coupled to an adjacent one of the panels. The screen door member is designed for being positioned proximate a garage door opposite the entrance to the garage when the garage door is in a closed position. The screen door member is designed for permitting air flow into the garage when the garage door is in an open position. A pair of track members are positioned on opposing sides of the screen door member. Each of the track members engages a plurality of rollers rotatably coupled to the screen door member whereby the track members are for guiding the screen door member when the screen door is moved from a lowered position to a raised position.

9 Claims, 7 Drawing Sheets

GARAGE SCREEN DOOR SYSTEM

BACKGROUND OF THE INVENTION

1. Field of the Invention

The present invention relates to screen door closures and more particularly pertains to a new garage screen door system for allowing air to flow into a garage while inhibiting foreign objects from entering while the garage door is in an open position.

2. Description of the Prior Art

The use of screen door closures is known in the prior art. U.S. Pat. No. 6,053,235 describes a device for positioning a screen door in the opening of a garage. Another type of screen door closure is U.S. Pat. No. 6,098,698 having a screened enclosure being positioned in the opening of the garage to prevent insects from entering the open garage. U.S. Pat. No. 4,712,598 has a screen curtain assembly coupled to the outside of the garage that is positionable over the opening in the garage to inhibit insects from entering the garage. U.S. Pat. No. 4,231,412 has a screen door construction that is coupled to the garage for placement in the opening of the garage to inhibit insects from entering the garage. U.S. Pat. No. 5,611,382 has a retractable screen assembly that is coupled to the garage door and extends from the bottom of the garage door when the garage door is partially raised. U.S. Pat. No. Des. 426,315 shows a free standing garage screen door.

While these devices fulfill their respective, particular objectives and requirements, the need remains for a system that has certain improved features allowing the screened door member to be selectively coupled to the garage door.

SUMMARY OF THE INVENTION

The present invention meets the needs presented above by providing a locking assembly for engaging the garage door so that the screen door member and the garage door can be move together.

Still yet another object of the present invention is to provide a new garage screen door system that inhibits insects from entering the garage while allowing air to flow freely through the garage.

Even still another object of the present invention is to provide a new garage screen door system that inhibits the entrance of insects around the screen door member.

To this end, the present invention generally comprises a screen door member comprising a plurality of panels. Each of the panels is hingably coupled to an adjacent one of the panels. The screen door member is designed for being positioned proximate a garage door whereby the garage door is positioned between the screen door member and the entrance to the garage when the garage door is in a closed position. The screen door member is designed for permitting air flow into the garage when the garage door is in an open position. A pair of track members are positioned on opposing sides of the screen door member. Each of the track members engages a plurality of rollers rotatably coupled to the screen door member whereby the track members are for guiding the screen door member when the screen door is moved from a lowered position to a raised position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
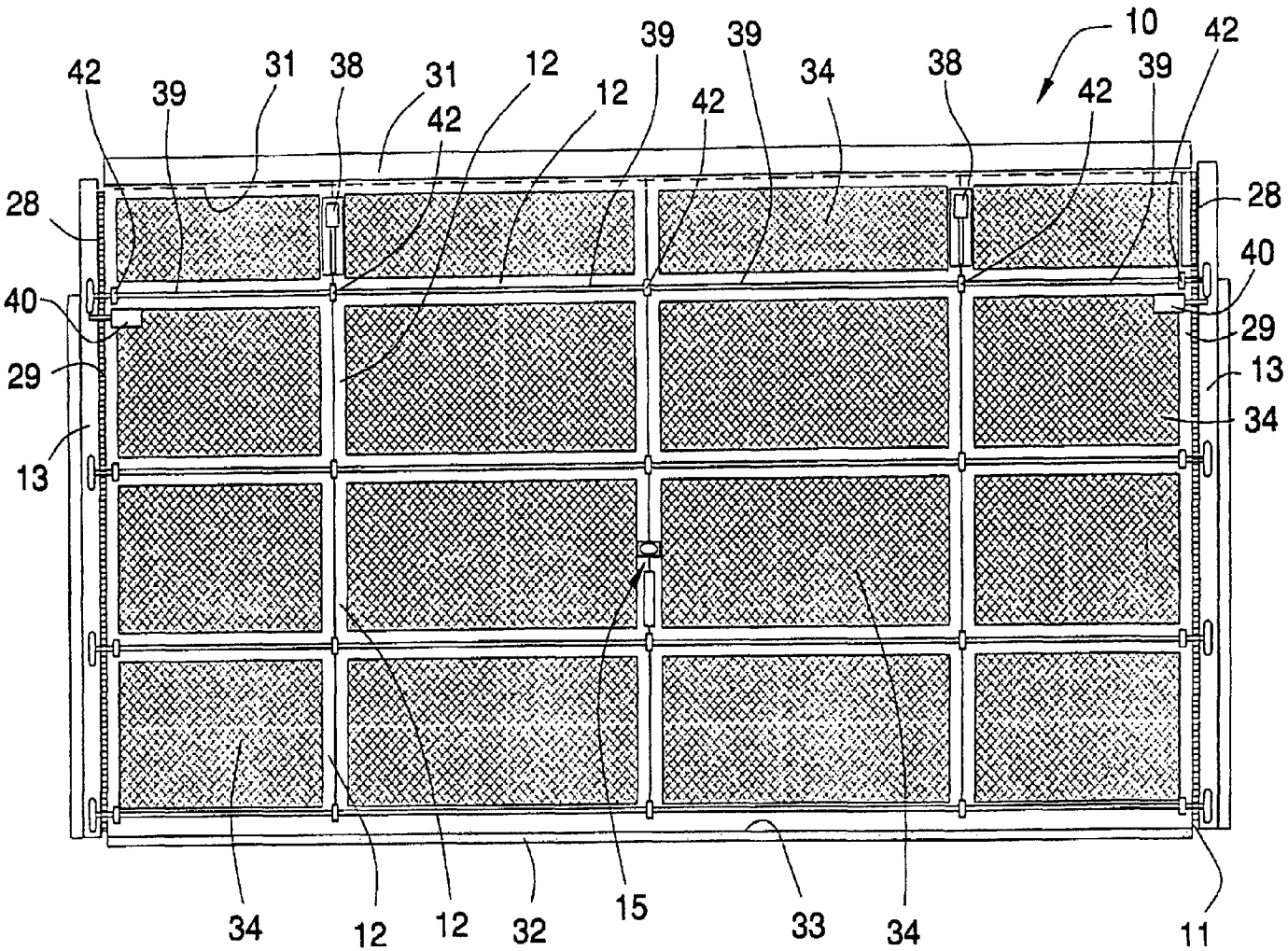
FIG. 1 is a rear view of a new garage screen door system according to the present invention.
Figure 2:
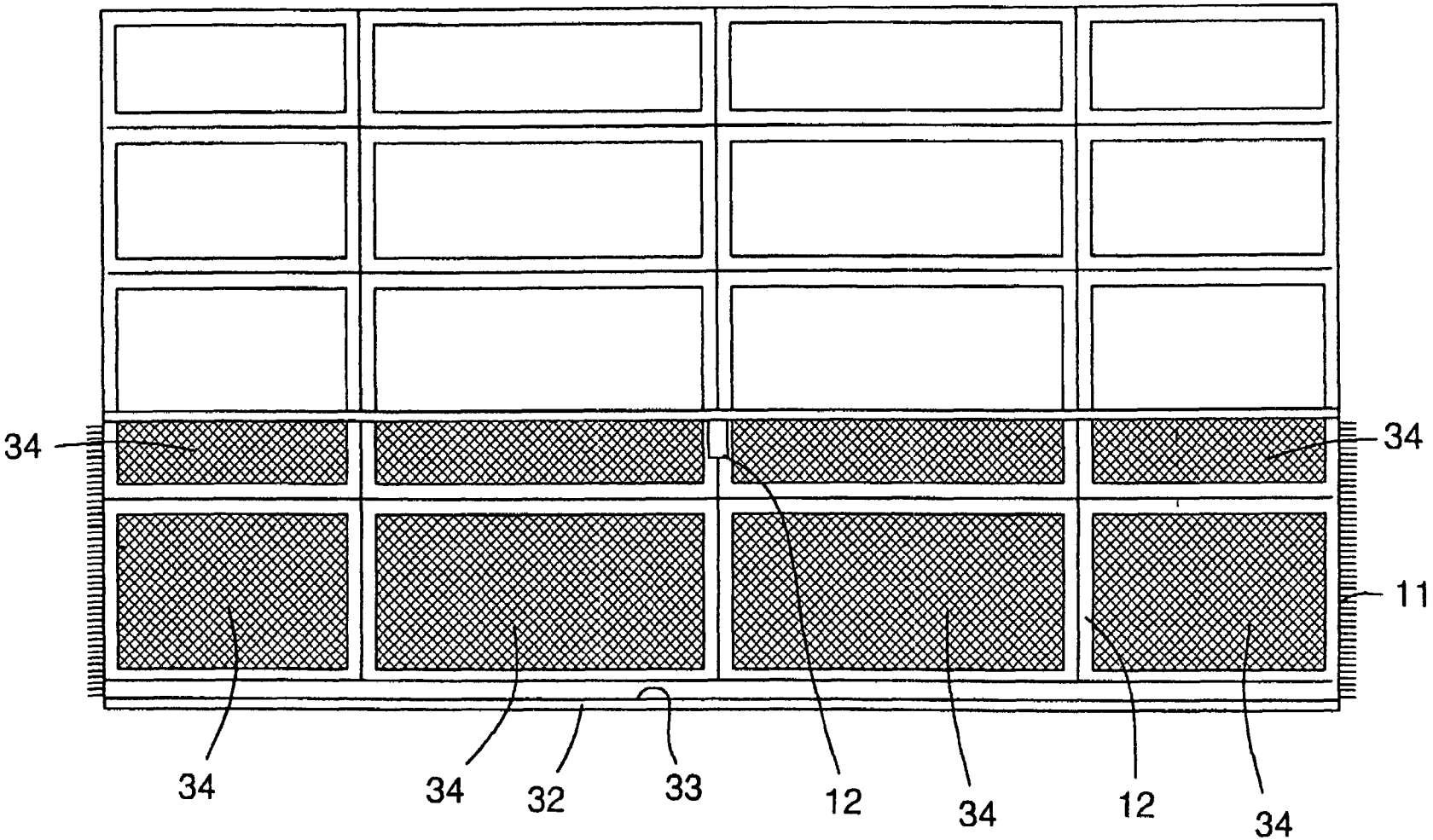
FIG. 2 is a front view of the present invention shown in use.
Figure 3:
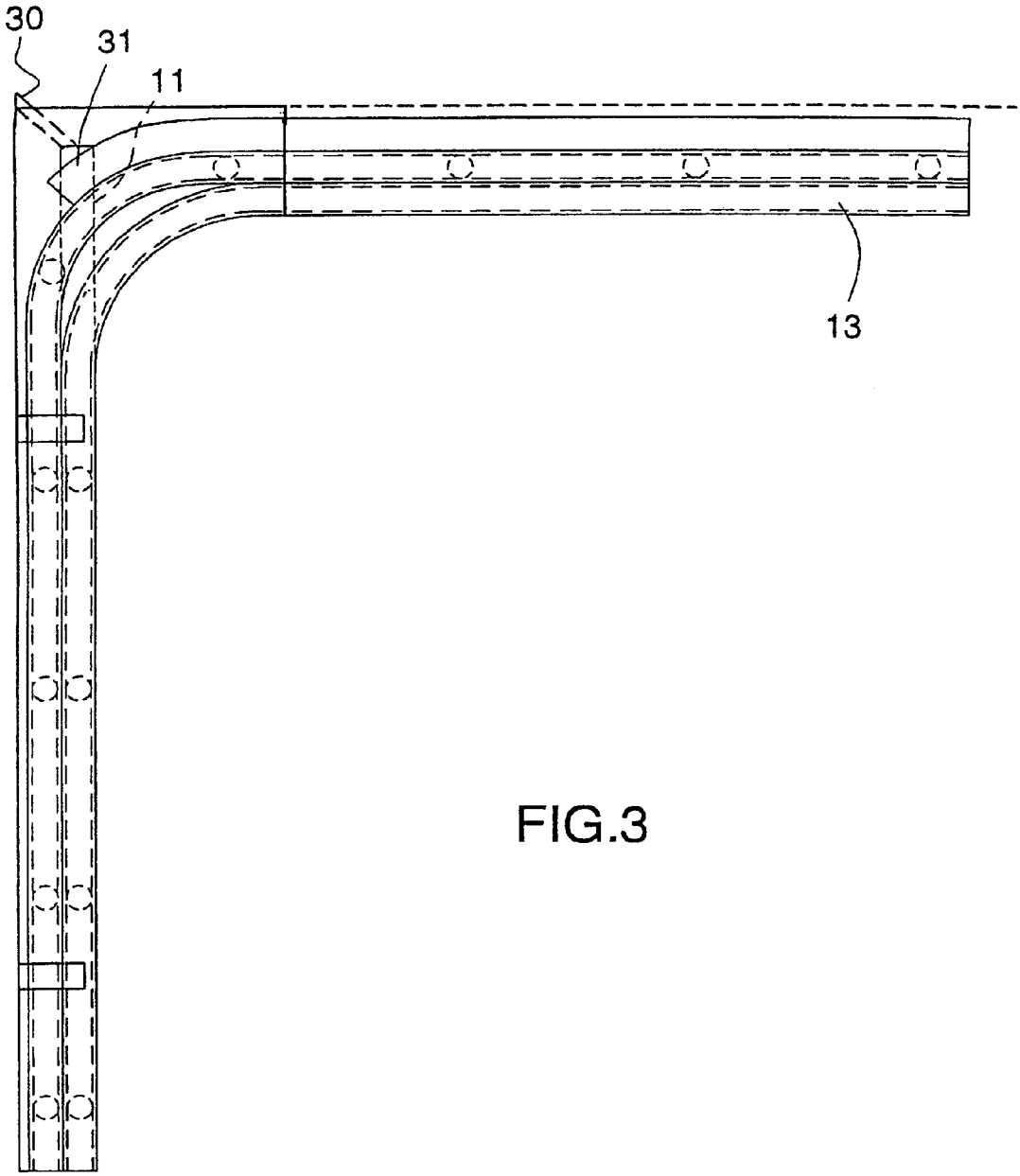
FIG. 3 is a side view of the present invention.
Figure 4:
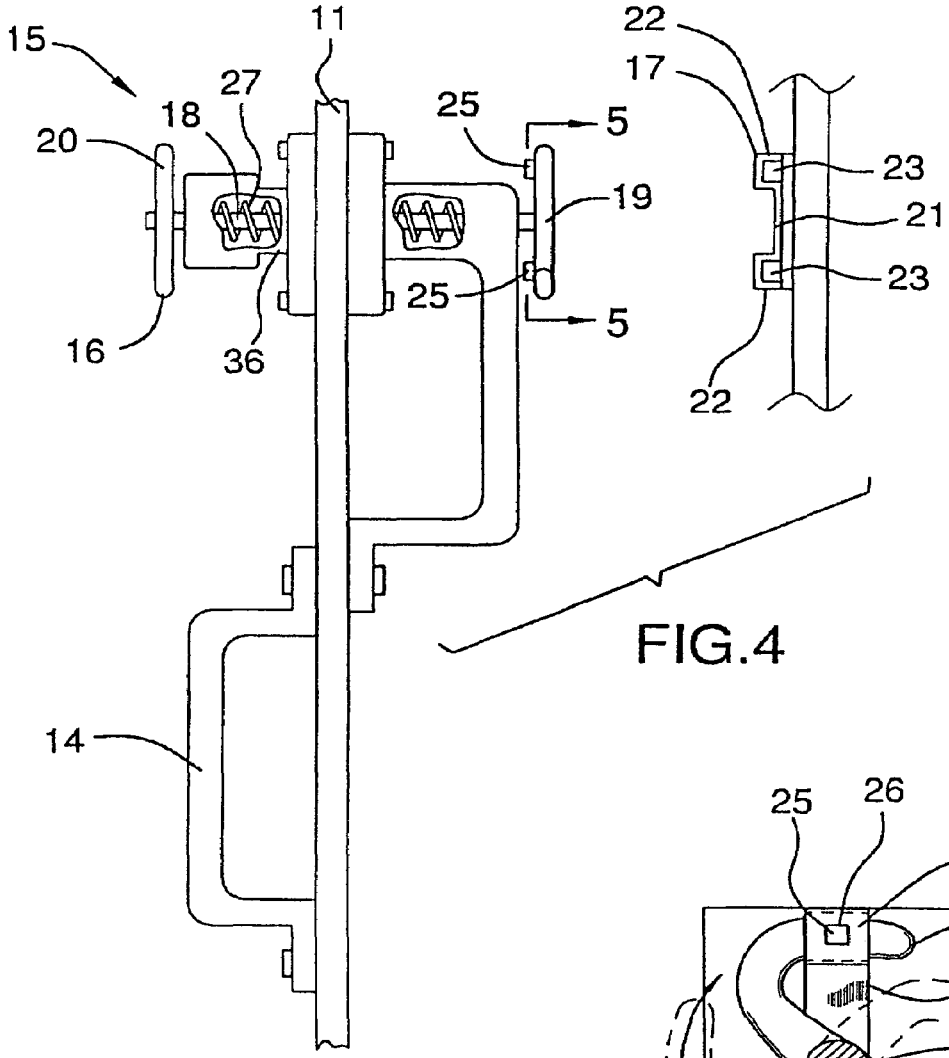
FIG. 4 is a side view of the locking assembly of the present invention.
Figure 5:
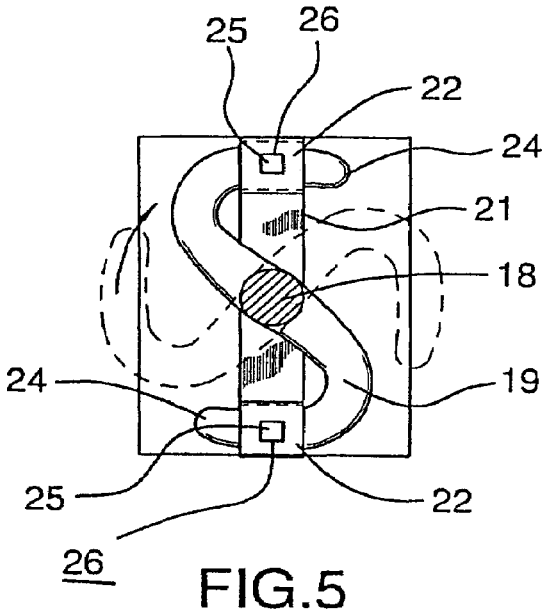
FIG. 5 is a cross-sectional view of the locking assembly of the present invention taken along line 5—5 of FIG. 4.
Figure 6:
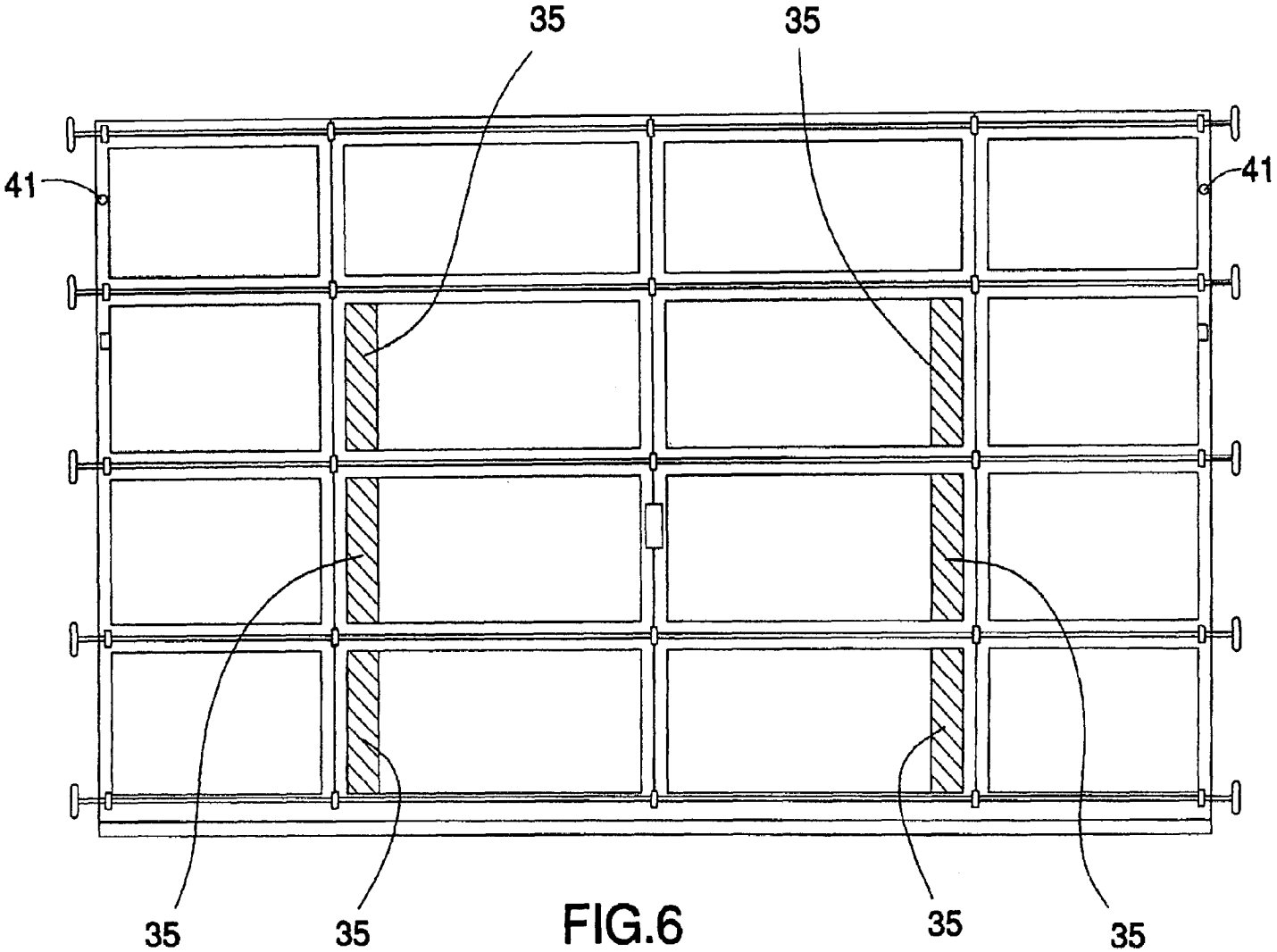
FIG. 6 is a rear view of the plate members of the present invention coupled to the garage door.
Figure 7:
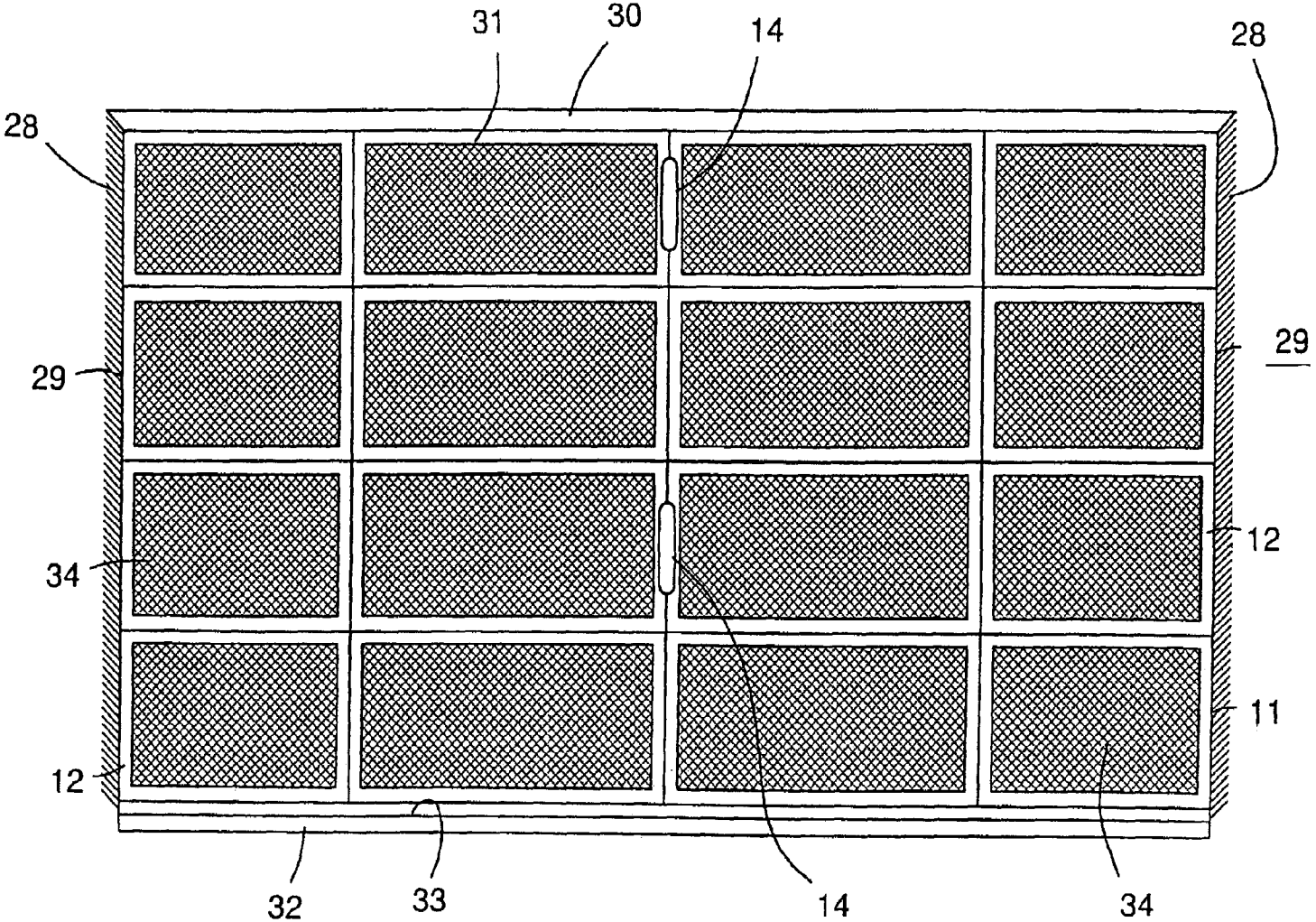
FIG. 7 is a front view of the screen door member of the present invention.
Figure 8:
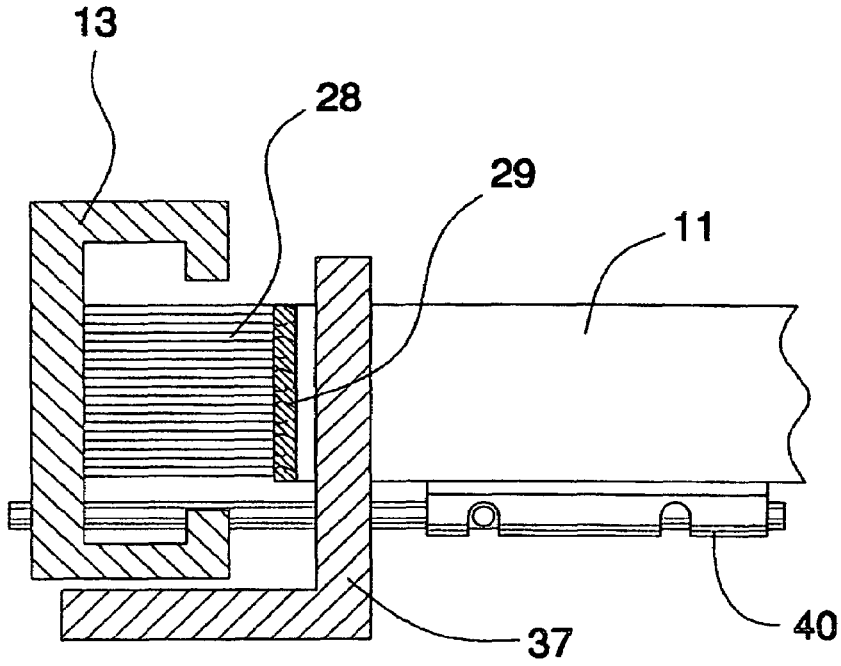
FIG. 8 is a cross-sectional view of the side sealing member and brush member of the present invention.

With reference now to the drawings, and in particular to FIGS. 1 through 8 thereof, a new garage screen door system embodying the principles and concepts of the present invention and generally designated by the reference numeral 10 will be described.

As best illustrated in FIGS. 1 through 8, the garage screen door system 10 generally comprises a screen door member 11 comprising a plurality of panels 12. Each of the panels 12 is hingably coupled to an adjacent one of the panels 12. The screen door member 11 is designed for being positioned proximate a garage door whereby the garage door is positioned between the screen door member 11 and the entrance to the garage when the garage door is in a closed position. The screen door member 11 is designed for permitting air flow into the garage when the garage door is in an open position.

A pair of track members 13 are positioned on opposing sides of the screen door member 11. Each of the track members 13 engages a plurality of rollers rotatably coupled to the screen door member 11 whereby the track members 13 are for guiding the screen door member 11 when the screen door is moved from a lowered position to a raised position. At least one lifting handle 14 may be coupled to the screen door member 11 to facilitate moving the screen door member 11 from the lowered position to the raised position.

A locking assembly 15 is coupled to the screen door member 11. The locking assembly 15 is designed for selectively engaging the garage door whereby the screen door is moved between the lowered position and the raised positioned when the garage door is moved between the closed position and the open position. The screen door member 11 is designed for being moved independently of the garage door when the locking assembly 15 is disengaged from the garage door.

The locking assembly 15 comprises a latching portion 16 and a bracket portion 17. The latching portion 16 is coupled to the screen door member 11 whereby the latching portion 16 extends through the screen door member 11. The bracket portion 17 is designed for being coupled to the garage door. The latching portion 16 selectively engages the bracket portion 17 whereby the latching portion 16 is designed for securing the screen door member 11 to the garage door.

The latching portion 16 of the locking assembly 15 comprises a shaft member 18, a lock member 19 and a handle member 20. The shaft member 18 extends through the screen door member 11. The lock member 19 is couple to the shaft member 18 whereby the lock member 19 is designed for being positioned between the screen door member 11 and the garage door. The handle member 20 is coupled to the shaft member 18 opposite the lock member 19. The lock member 19 selectively engages the bracket portion 17 for securing the screen door to the garage door when the handle member 20 is actuated by the user.

The bracket portion 17 comprises a medial portion 21 and a pair of end portions 22. Each of the end portions 22 is oppositely coupled to the medial portion 21. The medial portion 21 is designed for being coupled to the garage door. Each of the end portions 22 comprises a channel 23 whereby the channel 23 is designed for being positioned against the garage door.

The lock member 19 of the latching portion 16 is substantially S-shaped whereby opposing arms 24 of the lock member 19 are selectively inserted into the channels 23 of the end portions 22 of the bracket portion 17. The opposing arms 24 of the lock member 19 are designed for being secured between the end portion 22 of the bracket portion 17 and the garage door for securing the screen door member 11 to the garage door when the user actuates the handle member 20 of the locking assembly 15.

The lock member 19 of the latching portion 16 comprises a pair of tabs 25. Each of the tabs 25 outwardly extends from an associated one of the opposing arms 24 of the lock member 19. The tabs 25 of the lock member 19 are selectively inserted into a pair of slots 26 extending through the end portions 22 of the bracket portion 17 whereby the tabs 25 inhibit inadvertent disengagement of the lock member 19 from the bracket portion 17 when the opposing arms 24 of the lock member 19 are positioned in the channels 23 of the end portions 22 of the bracket portion 17.

The latching portion 16 of the locking assembly 15 comprises a biasing member 27. The biasing member 27 is positioned between the handle member 20 and a housing 36 of the latching portion 16 whereby the biasing member 27 biases the handle member 20 away from the screen door member 11 to keep the lock member 19 clear of the bracket portion 17 when the lock member 19 is disengaged from the bracket portion 17.

A plurality of brush members 28 are coupled to opposing side edges 29 of the screen door member 11. Each of the brush members 28 extends between the screen door member 11 and the track member 13 when the screen door member 11 is in the lowered position whereby the brush members 28 are designed for inhibiting foreign objects from entering the garage between the track members 13 and the opposing side edges 29 of the screen door member 11.

A plurality of side seal members 37 are coupled to the opposing side edges 29 of the screen door member 11. Each of the side seal members extends between the screen door member 11 and the associated one of the track members 13 whereby each of the side seal members 37 abuts the associated one of the track members 13 for inhibiting foreign objects from entering the garage between the track members 13 and the opposing side edges 29 of the screen door member 11.

A flap member 30 is hingably coupled to a top edge 31 of the screen door member 11. The flap member 30 is designed for extending between the top edge 31 of the screen door member 11 and the garage, preferably at an angle of 45 degrees, when the screen door member 11 is in the lowered position whereby the flap member 30 is for inhibiting foreign objects from entering the garage between the garage and the top edge 31 of the screen door member 11.

A seal member 32 is coupled to a bottom edge 33 of the screen door member 11. The seal member 32 comprises a substantially flexible material, such as rubber. The seal member 32 is designed for being positioned between the screen door member 11 and a floor of the garage when the screen door is in the lowered position whereby the seal member 32 is for inhibiting foreign objects from entering the garage between the garage and the bottom edge 33 of the screen door member 11. A seal 39 is positioned between each of the panels 12 and an adjacent one of the panels 12 to inhibit debris and bugs from entering the garage between the associated panels 12 when the screen door member is in the closed position.

Each of the panels 12 of the screen door member 11 comprises a plurality of mesh portions 34. The mesh portions 34 may also comprise a polarized design for limiting vision through the mesh portions 34. Each of the mesh portions 34 is positioned along a length of the associated one of the panels 12. Each of the mesh portions 34 is designed for permitting air to flow in and out of the garage while inhibiting foreign objects from entering the garage.

An upper one of the panels 12 of the screen door member 11 being pivotal away from the track members 13 when the garage door is in the lowered position. A plurality of plate members 35 are designed for being coupled to the garage door whereby the plate members 35 are positioned between the garage door and the screen door member 11. The plate members 35 engage a plurality of wheel members 38 rotatably coupled to the upper one of the panels 12 of the screen door member 11 and force the upper one of the panels 12 back towards the track members 13 to prevent the garage door hooking the screen door member 11 and damaging the screen door member 11 when the garage door is being opened. A spring hinge member 42 is coupled between the upper most one of panels 12 and the adjacent one of the panels 12 whereby the spring hinge member 42 forces the upper most one of the panels 12 into the open position.

The screen door member 11 may have a plurality of sliding lock members 40. The sliding lock members 40 selectively engage the track members 13 to prevent the screen door member 11 from movement.

A plurality of stopper members 41 are coupled to the garage door whereby each of the stopper members 41 engage the screen door member 11 to inhibit the screen door member 11 from being raised when the garage door is in the closed position.

In use, the user actuates the handle member 20 of the latching portion 16 of the locking assembly 15 to disengage the screen door member 11 from the garage door. The screen door can then be moved into the lowered position from the raised position to allow air to flow through the mesh portions 34 into the garage while still letting the person see out of the entrance into the garage and keeping foreign objects, such as insects, out of the garage. The handle member 20 can then be actuated again when the garage door and the screen door member 11 are aligned to allow the to secure the screen door member 11 to the garage door and allow them the be moved together.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A garage screen door system for screening off an entrance to a garage, the garage screen door system comprising:

a screen door member comprising a plurality of panels, each of said panels being hingably coupled to an adjacent one of said panels, said screen door member being adapted for being positioned proximate a garage door such that the garage door is positioned between said screen door member and the entrance to the garage when the garage door is in a closed position, said screen door member being adapted for permitting air flow into the garage when the garage door is in an open position; and a pair of track members being positioned on opposing sides of said screen door member, each of said track members engaging a plurality of rollers rotatably coupled to said screen door member such that said track members are for guiding said screen door member when said screen door is moved from a lowered position to a raised position and;

a locking assembly being coupled to said screen door member, said locking assembly being adapted for selectively engaging the garage door such that said screen door is moved between the lowered position and the raised positioned when the garage door is moved between the closed position and the open position, said screen door member being adapted for being moved independently of the garage door when said locking assembly is disengaged from the garage door; and said locking assembly comprising a latching portion and a bracket portion, said latching portion being coupled to said screen door member such that said latching portion extends through said screen door member, said bracket portion being adapted for being coupled to the garage door, said latching portion selectively engaging said bracket portion such that said latching portion is adapted for securing said screen door member to the garage door; and said latching portion of said locking assembly comprising a shaft member, a lock member and a handle member, said shaft member extending through said screen door member, said lock member being couple to said shaft member such that said lock member is adapted for being positioned between said screen door member and the garage door, said handle member is coupled to said shaft member opposite said lock member, said lock member selectively engaging said bracket portion for securing said screen door to the garage door when said handle member is actuated by the user; and said bracket portion comprising a medial portion and a pair of end portions, each of said end portions being oppositely coupled to said medial portion, said medial portion being adapted for being coupled to the garage door, each of said end portions comprising a channel such that said channel is adapted for being positioned against the garage door; and said lock member of said latching portion being substantially S-shaped such that opposing arms of said lock member are selectively inserted into said channels of said end portions of said bracket portion such that said opposing arms of said lock member are adapted for being secured between said end portions of said bracket portion and the garage door for securing said screen door member to the garage door when the user actuates said handle member of the locking assembly.

2. The garage screen door system as set forth in claim 1, further comprising:

said lock member of said latching portion comprising a pair of tabs, each of said tabs outwardly extending from an associated one of said opposing arms of said lock member, said tabs of said lock member being selectively inserted into a pair of slots extending through said end portions of said bracket portion such that said tabs inhibit inadvertent disengagement of said lock member from said bracket portion when said opposing arms of said lock member are positioned in said channels of said end portions of said bracket portion.

3. The garage screen door system as set forth in claim 1 further comprising:

said latching portion of said locking assembly comprising a biasing member, said biasing member being positioned between said handle member and a housing of said latching portion such that said biasing member biases said handle member away from said screen door member to keep said lock member clear of said bracket portion when said lock member is disengaged from said bracket portion.

4. The garage screen door system as set forth in claim 1, further comprising:

a plurality of brush members being coupled to opposing side edges of said screen door member, each of said brush members extending between said screen door member and an associated one of the track member when said screen door member is in the lowered position such that said brush members are adapted for inhibiting foreign objects from entering the garage between said track members and said opposing side edges of said screen door member.

5. The garage screen door system as set forth in claim 1, further comprising:

a plurality of side seal members being coupled to said opposing side edges of said screen door member, each of said side seal members extending between said screen door member and the associated one of said track members whereby each of said side seal members abuts the associated one of said track members for inhibiting foreign objects from entering the garage between said track members and said opposing side edges of said screen door member.

6. The garage screen door system as set forth in claim 1, further comprising:

a flap member being hingably coupled to a top edge of said screen door member, said flap member being adapted for extending screen door member is in the lowered position such that said flap member is for inhibiting foreign objects from entering the garage between the garage and said top edge of said screen door member.

7. The garage screen door system as set forth in claim 1, further comprising:

a seal member being coupled to a bottom edge of said screen door member, said seal member being adapted for being positioned between said screen door member and a floor of the garage when said screen door is in the lowered position such that said seal member is for inhibiting foreign objects from entering the garage between the garage and said bottom edge of said screen door member.

8. The garage screen door system as set forth in claim 1, further comprising:

each of said panels of said screen door member comprising a plurality of mesh portions, each of said mesh portions being positioned along a length of the associated one of said panels, each of said mesh portions being adapted for permitting air to flow in and out of the garage while inhibiting foreign objects from entering the garage.

9. A garage screen door system for screening off an entrance to a garage, the garage screen door system comprising:

a screen door member comprising a plurality of panels, each of said panels being hingably coupled to an adjacent one of said panels, said screen door member being adapted for being positioned proximate a garage door such that the garage door is positioned between said screen door member and the entrance to the garage when the garage door is in a closed position, said screen door member being adapted for permitting air flow into the garage when the garage door is in an open position;

a pair of track members being positioned on opposing sides of said screen door member, each of said track members engaging a plurality of rollers rotatably coupled to said screen door member such that said track members are for guiding said screen door member when said screen door is moved from a lowered position to a raised position;

a locking assembly being coupled to said screen door member, said locking assembly being adapted for selectively engaging the garage door such that said screen door is moved between the lowered position and the raised positioned when the garage door is moved between the closed position and the open position, said screen door member being adapted for being moved independently of the garage door when said locking assembly is disengaged from the garage door;

said locking assembly comprising a latching portion and a bracket portion, said latching portion being coupled to said screen door member such that said latching portion extends through said screen door member, said bracket portion being adapted for being coupled to the garage door, said latching portion selectively engaging said bracket portion such that said latching portion is adapted for securing said screen door member to the garage door;

said latching portion of said locking assembly comprising a shaft member, a lock member and a handle member, said shaft member extending through said screen door member, said lock member being couple to said shaft member such that said lock member is adapted for being positioned between said screen door member and the garage door, said handle member is coupled to said shaft member opposite said lock member, said lock member selectively engaging said bracket portion for securing said screen door to the garage door when said handle member is actuated by the user;

said bracket portion comprising a medial portion and a pair of end portions, each of said end portions being oppositely coupled to said medial portion, said medial portion being adapted for being coupled to the garage door, each of said end portions comprising a channel such that said channel is adapted for being positioned against the garage door;

said lock member of said latching portion being substantially S-shaped such that opposing arms of said lock member are selectively inserted into said channels of said end portions of said bracket portion such that said opposing arms of said lock member are adapted for being secured between said end portions of said bracket portion and the garage door for securing said screen door member to the garage door when the user actuates said handle member of the locking assembly;

said lock member of said latching portion comprising a pair of tabs, each of said tabs outwardly extending from an associated one of said opposing arms of said lock member, said tabs of said lock member being selectively inserted into a pair of slots extending through said end portions of said bracket portion such that said tabs inhibit inadvertent disengagement of said lock member from said bracket portion when said opposing arms of said lock member are positioned in said channels of said end portions of said bracket portion;

said latching portion of said locking assembly comprising a biasing member, said biasing member being positioned between said handle member and a housing of said latching portion such that said biasing member biases said handle member away from said screen door member to keep said lock member clear of said bracket portion when said lock member is disengaged from said bracket portion;

a plurality of brush members being coupled to opposing side edges of said screen door member, each of said brush members extending between said screen door member and said track member when said screen door member is in the lowered position such that said brush members are adapted for inhibiting foreign objects from entering the garage between said track members and said opposing side edges of said screen door member;

a plurality of side seal members being coupled to said opposing side edges of said screen door member, each of said side seal members extending between said screen door member and the associated one of said track members whereby each of said side seal members abuts the associated one of said track members for inhibiting foreign objects from entering the garage between said track members and said opposing side edges of said screen door member;

a flap member being hingably coupled to a top edge of said screen door member, said flap member being adapted for extending between said top edge of said screen door member and the garage when said screen door member is in the lowered position such that said flap member is for inhibiting foreign objects from entering the garage between the garage and said top edge of said screen door member;

a seal member being coupled to a bottom edge of said screen door member, said seal member being adapted for being positioned between said screen door member and a floor of the garage when said screen door is in the lowered position such that said seal member is for inhibiting foreign objects from entering the garage between the garage and said bottom edge of said screen door member; and each of said panels of said screen door member comprising a plurality of mesh portions, each of said mesh portions being positioned along a length of the associated one of said panels, each of said mesh portions being adapted for permitting air to flow in and out of the garage while inhibiting foreign objects from entering the garage.

* * * * *